US011586137B2

(12) United States Patent
Tomatsu et al.

(10) Patent No.: US 11,586,137 B2
(45) Date of Patent: Feb. 21, 2023

(54) CONVEYOR AND IMAGE RECORDING APPARATUS

(71) Applicant: BROTHER KOGYO KABUSHIKI KAISHA, Nagoya (JP)

(72) Inventors: Yoshiya Tomatsu, Kasugai (JP); Mitsugi Tanaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 248 days.

(21) Appl. No.: 17/120,835

(22) Filed: Dec. 14, 2020

(65) Prior Publication Data

US 2021/0181666 A1 Jun. 17, 2021

(30) Foreign Application Priority Data

Dec. 16, 2019 (JP) ..... JP2019-226127

(51) Int. Cl.

| | |
|---|---|
| ***B41J 15/16*** | (2006.01) |
| ***G03G 15/00*** | (2006.01) |
| ***B65H 23/04*** | (2006.01) |
| ***B65H 20/06*** | (2006.01) |
| ***B65H 16/00*** | (2006.01) |

(52) U.S. Cl.

CPC ..... *G03G 15/6529* (2013.01); *B65H 16/005* (2013.01); *B65H 20/06* (2013.01); *B65H 23/04* (2013.01)

(58) Field of Classification Search

CPC ..... B41J 15/16; B65H 23/16

See application file for complete search history.

(56) References Cited

U.S. PATENT DOCUMENTS

| | | | | |
|---|---|---|---|---|
| 3,085,457 A * | 4/1963 | Fischer | B65H 20/24 | 226/114 |
| 7,419,318 B2 * | 9/2008 | Hayakawa | B41J 15/18 | 400/605 |
| 8,366,262 B2 * | 2/2013 | Miyamoto | B65H 23/16 | 242/566 |
| 8,474,971 B2 * | 7/2013 | Okazaki | B65H 23/32 | 347/104 |

(Continued)

FOREIGN PATENT DOCUMENTS

| | | |
|---|---|---|
| JP | H11-246093 A | 9/1999 |
| JP | 2011-093218 A | 5/2011 |

*Primary Examiner* — Leslie A Nicholson, III

(74) *Attorney, Agent, or Firm* — Scully, Scott, Murphy & Presser, PC

(57) ABSTRACT

A conveyor includes: a receiver that detachably receives a roll-like sheet; a conveyance unit that conveys the sheet in a conveyance orientation along a conveyance surface; and a tensioner that applies tension to the sheet at a position upstream of the conveyance unit in the conveyance orientation. The tensioner includes: a frame having a groove pair extending in a first direction along the conveyance orientation; a guide having a curved surface that contacts the sheet and an engagement member pair that engages with the groove pair; a pivoting member that pivots around an axis extending in a second direction orthogonal to the first direction and parallel to the conveyance surface; a transmission member that transmits pivoting of the pivoting member to the guide; and an urging member that applies urging force including a component in the first direction to the guide.

16 Claims, 6 Drawing Sheets

(56) References Cited

U.S. PATENT DOCUMENTS

| | | | | |
|---|---|---|---|---|
| 9,027,867 | B2 * | 5/2015 | Miyamoto | B65H 23/038 242/419.6 |
| 9,238,379 | B2 * | 1/2016 | Takizawa | B41J 13/0009 |
| 9,446,613 | B2 * | 9/2016 | Nakano | B41J 11/00216 |
| 10,369,821 | B2 * | 8/2019 | Pérez Muñoz | B65H 23/0204 |
| 2015/0239267 | A1 * | 8/2015 | Nakano | B41J 15/16 347/102 |
| 2022/0063309 | A1 * | 3/2022 | Ito | B41J 11/706 |

* cited by examiner

CONVEYOR AND IMAGE RECORDING APPARATUS

CROSS REFERENCE TO RELATED APPLICATION

The present application claims priority from Japanese Patent Application No. 2019-226127 filed on Dec. 16, 2019, the disclosure of which is incorporated herein by reference in its entirety.

BACKGROUND

Field of the Invention

The present disclosure relates to a conveyor of a roll-like sheet and an image recording apparatus using the conveyor.

Description of the Related Art

In a conveyor of an image recording apparatus, a sheet is rotatably installed in a receiver. The sheet is pulled out from the receiver and conveyed along a conveyance path. In the conveyance path, the sheet curves along an outer circumferential surface of a tension roller and is fed to a conveyance unit. During this operation, the tension roller applies tension to the sheet being conveyed. The conveyance unit feeds the sheet in a predefined conveyance orientation. This feeds the sheet in a gap between a recording unit and a platen along the conveyance orientation (see, for example, Japanese Patent Application Laid-open No. 2011-93218).

SUMMARY

In Japanese Patent Application Laid-open No. 2011-93218, the tension roller is supported by a support frame that is linearly movable in the conveyance orientation and an orientation opposite to the conveyance orientation along a guide hole extending in the conveyance orientation. Urging force in the orientation opposite to the conveyance orientation is applied to the support frame. This allows the tension roller to apply tension to the sheet. In this configuration, however, the outer circumferential surface of the tension roller is likely to be inclined to an orientation orthogonal to the conveyance orientation, which easily causes sheet skew with respect to the conveyance orientation in the gap between the recording unit and the platen.

The present disclosure is made to solve the above problem, and an object of the present disclosure is to provide a conveyor that is capable of inhibiting sheet skew and an image recording apparatus including the conveyor.

According to a first aspect of the present disclosure, there is provided a conveyor, including: a receiver configured to detachably receive a roll-like sheet, a conveyance unit configured to convey the sheet pulled out from the receiver in a conveyance orientation along a conveyance surface; and a tensioner configured to apply tension to the sheet at a position upstream of the conveyance unit in the conveyance orientation, wherein the tensioner includes: a frame having a groove pair each extending in a first direction along the conveyance orientation, a guide having a curved surface configured to contact the sheet and an engagement member pair configured to engage with the groove pair, a pivoting member configured to pivot around an axis extending in a second direction that is orthogonal to the first direction and is parallel to the conveyance surface, a transmission member configured to transmit pivoting of the pivoting member to the guide, and an urging member configured to apply, to the guide, urging force including a component in the first direction.

According to a second aspect of the present disclosure, there is provided an image recording apparatus, including: the conveyor as defined in the first aspect, and a recording unit configured to record an image on the sheet at a position separated from the conveyance unit in the conveyance orientation.

In the above configuration, pivoting of the pivoting member around the shaft extending in the second direction is transmitted to the guide. Thus, the guide moving in the first direction by being guided by the frame is not likely to rattle in the second direction. Accordingly, it is possible to provide the conveyor capable of inhibiting sheet skew and the image recording apparatus including the conveyor.

BRIEF DESCRIPTION OF THE DRAWINGS

FIGS. 6A and 6B each schematically depict a configuration of the tensioner according to a second modified example, wherein FIG. 6A depicts a vertical section parallel to a front-rear direction when seen from a right side, and FIG. 6B depicts a vertical section taken along a line VIB-VIB in FIG. 6A when seen from a rear side.

DESCRIPTION OF THE EMBODIMENTS

Figure 1:
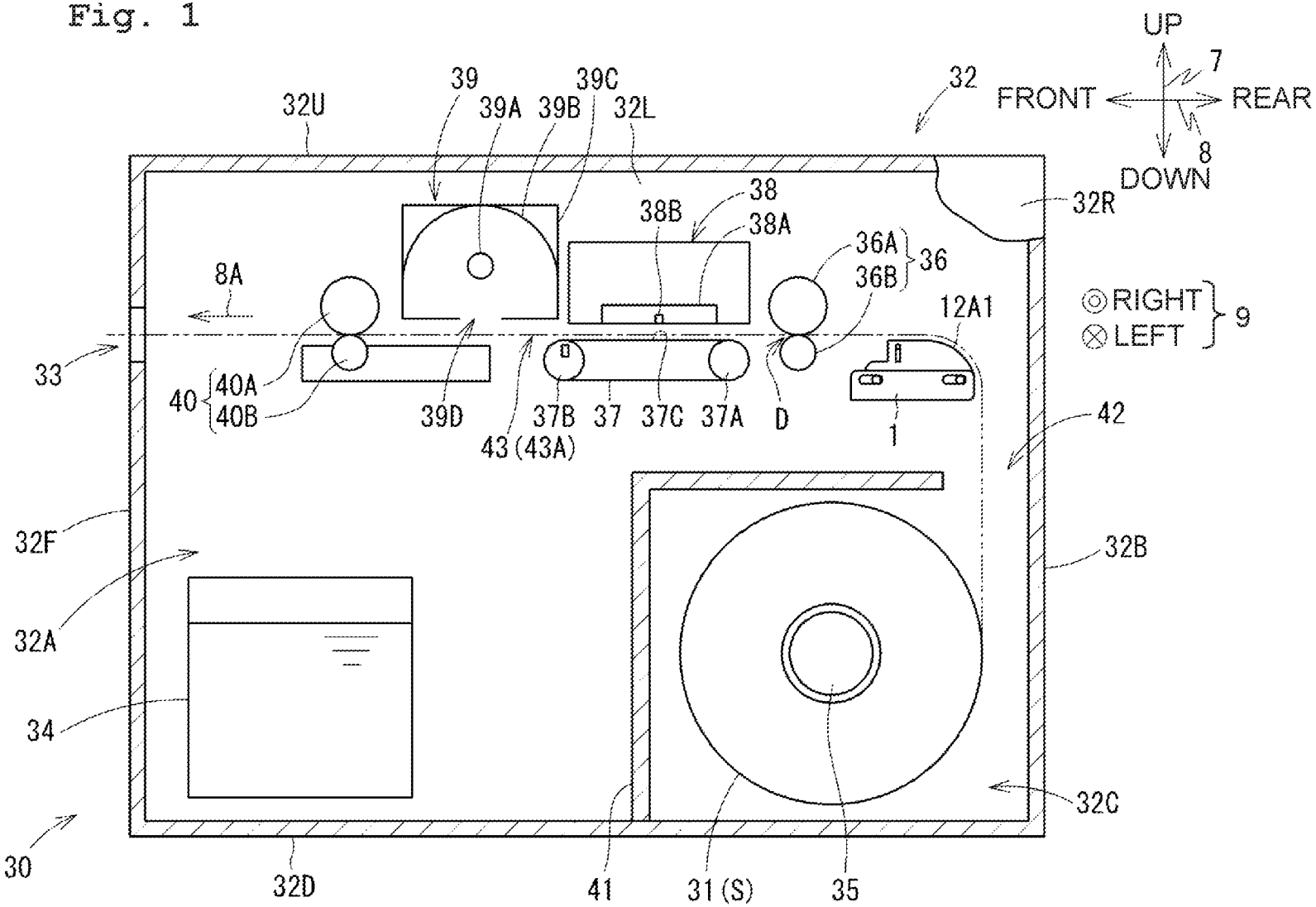
FIG. 1 schematically depicts a configuration of an image recording apparatus provided with a conveyor according to an embodiment.

Explanation is made below about an image recording apparatus 30 according to an embodiment of the present disclosure. The embodiment explained below is just an example of the present disclosure. It is needless to say that appropriate modifications may be made within the present disclosure without departing from the gist or scope of the present disclosure. In the following, an up-down direction 7 is defined with a state where the image recording apparatus 30 is placed to be usable (a state in FIG. 1) as the reference. A front-rear direction 8 is defined with a side on which a discharge opening 33 is provided as a frontward side (front surface or front side), and a left-right direction 9 is defined as viewing the image recording apparatus 30 from the frontward side (front surface). The up-down direction 7 is an exemplary third direction, the front-rear direction 8 is an exemplary second direction, and the left-right direction 9 is an exemplary first direction. Upward (upper) and downward (lower) orientations are components of the up-down direction 7. Leftward (left) and rightward (right) orientations are components of the left-right direction 9. Frontward (front) and rearward (rear) orientations are components of the front-rear direction 8.

<Appearance Configuration of Image Recording Apparatus 30>

As depicted in FIG. 1, the image recording apparatus 30 record an image on a sheet S or the like forming a roll body 31, by an ink-jet recording method. A casing 32 of the image recording apparatus 30 has a substantially rectangular parallelepiped shape, and is sized to be placed on a tabletop. That is, the image recording apparatus 30 is suitable for use by being placed on the table or desk. Of course, the image recording apparatus 30 may be used while being placed on a floor surface or a rack.

The casing 32 has a right surface 32R, a left surface 32 L, an upper surface 32U, a lower surface 32D, a front surface 32F, and a rear surface 32B. As a result, the inner space 32A of the casing 32 is partitioned from the outside. In FIG. 1, only a part of the right surface 32R is shown, and the remaining part of the right surface 32R is omitted to show the configuration of inside of the image recording device 30. The right surface 32R and the left surface 32L are separated from each other in the left-right direction 9. The upper surface 32U and the lower surface 32D are separated from each other in the up-down direction 7, and connect the right surface 32R and the left surface 32L. The front surface 32F and the rear surface 32B are separated from each other in the front-rear direction 8, and connect the upper surface 32U and the lower surface 32D.

A slit-shaped discharge port 33 that is long in the left-right direction 9 is located in the front surface 32F. Sheets S on which images are recorded are discharged from the discharge port 33.

In addition, the operation panel and the front cover (both not shown) ma be provided for the front surface 32F. Through the operation panel, the user performs various types of input to the image recording apparatus 30. The front cover is located at a lower portion of the front surface 32F. The tank 34 or the like located in the internal space 32A is exposed or shielded due to opening or closing of the front cover.

<Internal Configuration of Image Recording Apparatus 30>

As depicted in FIG. 1, a holder 35, the tensioner 1, a conveyance roller pair 36, a conveyance belt 37, a recording head 38, a fixing unit 39, a conveyance roller pair 40, and the tank 34 are arranged in the internal space 32A. A maintenance unit, such as a cap coving a nozzle surface of the recording head 38 and a wiper wiping off the nozzle surface, a power circuit, and the like are arranged in the internal space of the casing 32. Since the maintenance unit and the power circuit are not main parts of this embodiment, illustration thereof and explanation therefor are omitted.

A partition wall 41 is provided in the internal space 32A. The partition wall 41 partitions a sheet accommodating space 32C in a rear lower portion of the internal space 32A. The sheet accommodating space 32C is surrounded by the partition wall 41 and the casing 32 (in particular, the rear surface 32B, the lower surface 32D, and the right surface 32R). The sheet accommodating space 32C is a space isolated from the recording head 38 and the like. Each of the casing 32 and the partition wall 41 is an exemplary receiver. A conveyor is formed at least by the receiver, the conveyance roller pair 36, and the tensioner 1.

At least the roll body 31 is accommodated in the sheet accommodating space 32C. The roll body 31 includes a core tube and the long sheet S. The sheet S is wound around the core tube into a roll shape in a circumference direction of a shaft core (axis) of the core tube. The roll body 31 may not have the core tube and may have a roll-like shape so that the sheet S can be installed in the holder 35. The sheet S has a sheet width A (see FIG. 2) in a width direction along the shaft core of the core tube. The holder 35 extending in the left-right direction 9 is positioned in the sheet accommodating space 32C. The roll body 31 is installed in the holder 35. When the roll body 31 is installed in the holder 35, the shaft core of the core tube of the roll body 31 is along in the left-right direction 9, and the holder 35 supports the roll body 31 so that the roll body 31 can rotate in the circumferential direction of the shaft core. The center in the width direction of the sheet S is positioned at the center in the left-right direction 9 of a conveyance path 43 (hereinafter also referred to as "sheet passing center C"). The holder 35 rotates by receiving rotational force from a motor (not depicted). The roll body 31 supported by the holder 35 rotates along with the rotation of the holder 35. A right cover is positioned in the right surface 32R of the casing 32. The holder 35 and the like in the sheet accommodating space 32C are exposed or covered through the opening/closing of the right cover. The sheet accommodating space 32C may accommodate fanfold paper.

A rear portion of the sheet accommodating space 32C is opened upward. Specifically, a gap 42 is formed between the partition wall 41 and the rear surface 32B, in other words, above a rear end of the roll body 31. Rotating the conveyance roller pairs 36 and 40 pulls out the sheet S upward from the rear end of the roll body 31 and guides the sheet S to the tensioner 1.

As depicted in FIG. 1, the tensioner 1 is positioned above the partition wall 41 at a rear portion of the internal space 32A. The tensioner 1 has an outside curved surface 12A1. The outside curved surface 12A1 is an exemplary curved surface. The outside curved surface 12A1 is oriented toward the outside of the casing 32. Specifically, the outside curved surface 12A1 faces the upper surface 32U and the rear surface 32B.

Figure 2:
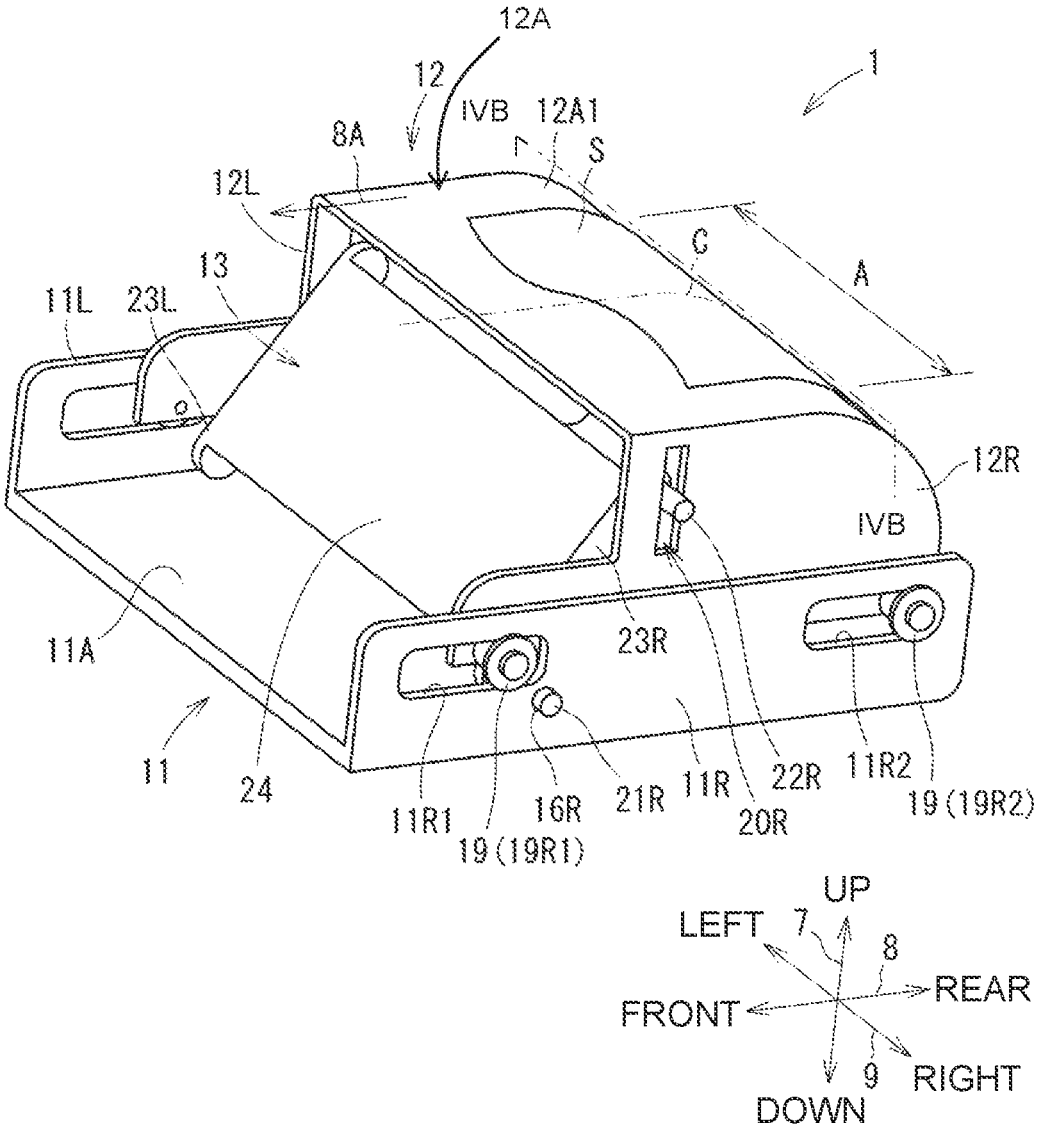
FIG. 2 is a perspective view of a tensioner in FIG. 1 when seen from a forward and upper right oblique side.

As depicted in FIG. 2, the outside curved surface 12A1 is larger than the sheet width A in the left-right direction 9. The outside curved surface 12A1 has a shape symmetrical with respect to the sheet passing center C.

As depicted in FIG. 1, a rear end of the outside curved surface 12A1 is at substantially the same position as the rear end of the roller body 31 in the front-rear direction 8. However, the position in the front-rear direction 8 of the rear end of the outside curved surface 12A1 changes. The rear end of the outside curved surface 12A1 is positioned at the lower side of a nip D of the conveyance roller pair 36 in the up-down direction 7. An upper end of the outside curved surface 12A1 is positioned at the obliquely upper frontward side of a lower end of the outside curved surface 12A1. The upper end of the outside curved surface 12A1 is at substantially the same position as the nip D in the up-down direction 7. A portion between the upper end and the lower end of the outside curved surface 12A1 swells toward the outside of the casing 32 (i.e., toward the obliquely upper rearward side).

The sheet S pulled out from the roll body 31 is brought into contact with the outside curved surface 12A1 having the above configuration. The sheet S curves frontward along the outside curved surface 12A1, extends in a conveyance orientation 8A, and is guided by the conveyance roller pair 36. The conveyance orientation 8A is the frontward orientation in the front-rear direction 8. The tensioner 1 applies tension to the sheet S using a mechanism explained below in details.

The conveyance roller pair 36 (an example of a conveyance unit) is positioned at the front side of the tensioner 1. The conveyance roller pair 36 includes a conveyance roller 36A and a pinch roller 36B. The conveyance roller 36A and the pinch roller 36B are brought into contact with the upper end of the outside curved surface 12A1 at substantially the same position in the up-down direction 7, forming the nip D. The conveyance roller pair 40 is positioned at the front side of the conveyance roller pair 36. The conveyance roller pair 40 includes a conveyance roller 40A and a pinch roller 40B. The conveyance roller 40A and the pinch roller 40B are brought into contact with the upper end of the outside curved surface 12A1 at substantially the same position in the up-down direction 7, forming a nip. The conveyance rollers 36A and 40A rotate by receiving rotational force of a motor (not depicted). The conveyance roller pair 36 rotates while nipping the sheet S that extends from the tensioner 1 in the conveyance orientation 8A, thus feeding the sheet S in the conveyance orientation 8A along a conveyance surface 43A. The conveyance roller pair 40 rotates while nipping the sheet S fed from the conveyance roller pair 36, thus feeding the sheet S in the conveyance orientation 8A. The rotation of the conveyance roller pairs 36 and 40 pulls out the sheet S from the sheet accommodating space 32C toward the tensioner 1 so that the sheet P passes through the gap 42.

As depicted in FIG. 1, the internal space 32A is formed having the conveyance path 43 that extends from the upper end of the outside curved surface 12A1 to the discharge opening 33. The conveyance path 43 extends substantially linearly along the conveyance orientation 8A. The conveyance path 43 is a space through which the sheet S can pass. Specifically, the conveyance path 43 is along the conveyance surface 43A that extends in the conveyance orientation 8A and the left-right direction 9 and is long in the conveyance orientation 8A. In FIG. 1, the conveyance surface 43A is depicted by a dot-dot-dash chain line that indicates the conveyance path 43. The conveyance path 43 is defined by guide members (not depicted) positioned apart from each other in the up-down direction 7, the recording head 38, the conveyance belt 37, the fixing unit 39, and the like. That is, the recording head 38, the conveyance belt 37, and the fixing unit 39 are positioned along the conveyance path 43.

The recording head 38 (an example of a recording unit) is positioned above the conveyance path 43 at a position downstream of the conveyance roller pair 36. The recording head 38 includes a discharge module 38A. In the discharge module 38A, nozzles 38B are arranged in a row in the left-right direction 9. Ink droplets are discharged downward from the nozzles 38B toward the sheet S conveyed by the conveyance belt 37. An image is thus recorded on the sheet S. Only one nozzle 38B is depicted in FIG. 1. The nozzles 38B may be arranged in two or more rows apart from each other in the front-rear direction 8.

The tank 34 stores ink. Ink is a liquid including pigment and the like. Ink has viscosity that is suitable for dispersing pigment uniformly. Pigment is a substance determining an ink color. Although not depicted, ink is supplied from the tank 34 to the recording head 38 via a tube.

The conveyance belt 37, a driving roller 37A, and a driven roller 37B are positioned below the recording head 38. The driving roller 37A is apart from the driven roller 37B in the front-rear direction 8. The conveyance belt 37, which is an endless belt, is stretched between the driving roller 37A and the driven roller 37B. The driving roller 37A rotates by driving force from a motor (not depicted), thus rotating the conveyance belt 37. Along with the rotation of the conveyance belt 37, the driven roller 37B rotates. The conveyance belt 37 has a conveyance surface 37C. The conveyance surface 37C is part of an upper end of an outer circumference surface of the conveyance belt 37. The conveyance surface 37C faces the nozzles 38B of the recording head 38 with the conveyance path 43 interposed therebetween. The driving roller 37A rotates so that the conveyance surface 37C moves in the conveyance orientation 8A. The conveyance surface 37C applies conveyance force to the sheet S while supporting the sheet S conveyed between the conveyance roller pairs 36 and 40 from below. This allows the conveyance belt 37 to convey the sheet S positioned on the conveyance path 43 in the conveyance orientation 8A.

The fixing unit 39 is disposed above the conveyance path 43 at a position downstream of the recording head 38 and upstream of the conveyance roller pair 40 in the conveyance orientation 8A. The fixing unit 39 is a halogen heater that is long in the left-right direction 9 and has a substantially rectangular parallelepiped shape. The fixing unit 39 includes a halogen lamp 39A, a reflective plate 39B, and a casing 39C. A lower wall of the casing 39C is formed having an opening 39D along in the left-right direction 9. The fixing unit 39 radiates infrared light through the opening 39D, and heats the sheet S passing through a position immediately below the opening 39D and/or ink on the sheet S. This fixes ink on the sheet S.

<Detailed Configuration of Tensioner 1>

Figure 3A:
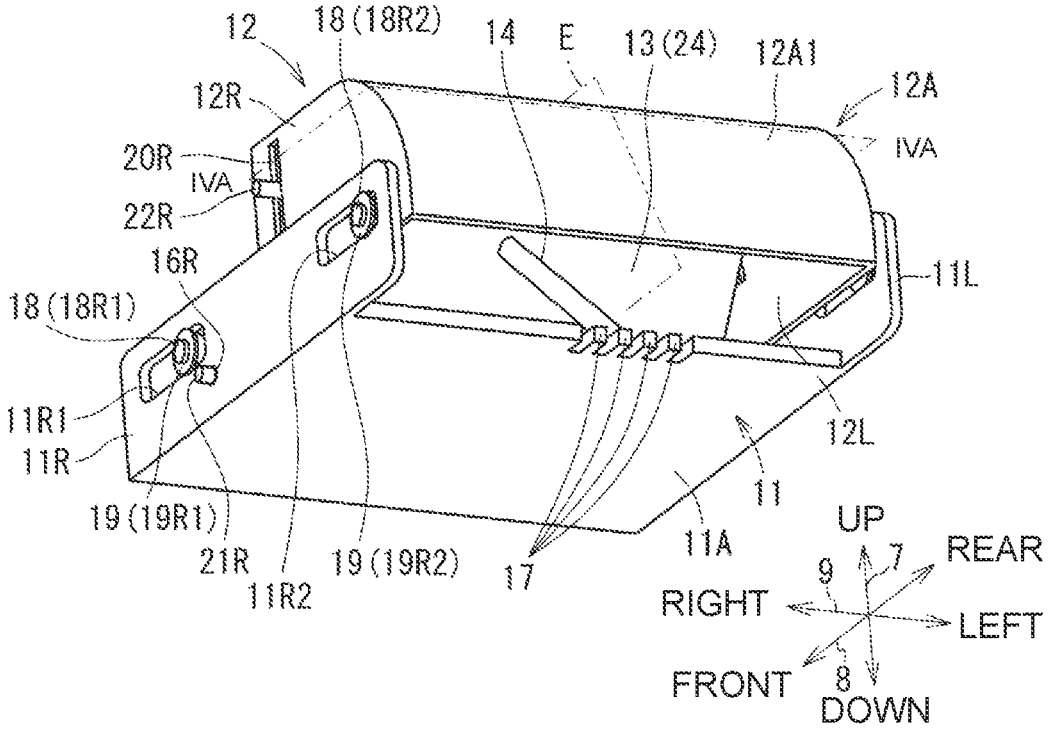
FIG. 3A is a perspective view of the tensioner in FIG. 2 when seen from a rearward and lower right oblique side.

As depicted in FIG. 2, the tensioner 1 includes a frame 11, a guide 12, a pivoting member 13, and an urging member 14 (see FIG. 3).

The frame 11 is made, for example, from metal. The frame 11 is attached to the casing 32 (see FIG. 1). The frame 11 has a right wall 11R extending upward from a right end of a bottom portion 11A and a left wall 11L extending upward from a left end of the bottom portion 11A.

The right wall 11R has a plate-like shape that is thin in the left-right direction 9 and is long in the front-rear direction 8. The right wall 11R has guide grooves 11R1 and 11R2. The guide groove 11R1 is a hole that is positioned close to a front end of the right wall 11R and passes through the right wall 11R in the left-right direction 9. The guide groove 11R1 is long in the front-rear direction 8. The guide groove 11R1 has a substantially rectangular shape when seen from the left-right direction 9. An upper end and a lower end of the guide groove 11R extend parallel to the front-rear direction 8. The guide groove 11R2 is positioned close to a rear end of the right wall 11R. The guide groove 11R2 has a shape similar to the guide groove 11R1. A bearing 16R, which is a hole that passes through the right wall 11R in the left-right direction 9, is formed at the slightly lower side of the rear end of the guide groove 11R1.

Figure 3B:
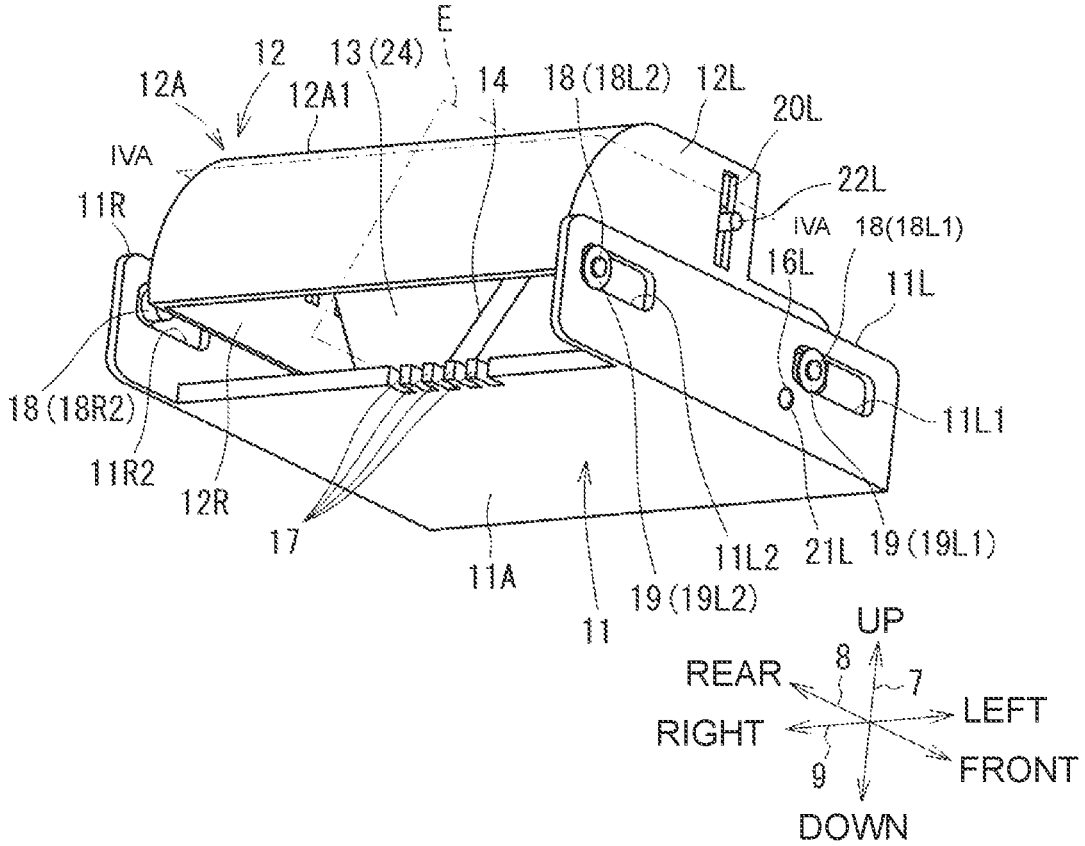
FIG. 3B is a perspective view of the tensioner in FIG. 2 when seen from a rearward lower left oblique side.

As depicted in FIG. 3B, the left wall 11L has a shape similar to the right wall 11R. A distance between the left wall 11L and the right wall 11R is slightly longer than a left-right size of the guide 12. The left wall 11L is formed having guide grooves 11L1 and 11L2 at positions corresponding to the guide grooves 11R1 and 11R2 (see FIG. 3A) in the left-right direction 9. A pair of the guide grooves 11L1, 11R1 and a pair of the guide grooves 11L2, 11R2 are an exemplary groove pair. The left wall 11L is formed having a bearing 16L at a position facing the bearing 16R (see FIG. 3A) of the right wall 11R in the left-right direction 9. Shafts 21R and 21L described below are inserted into the respective bearings 16R and 16L.

A comb-teeth portion is formed at a rear end of the bottom portion 11A to extend leftward from the center in the left-right direction 9. The comb-teeth portion include convex portions that are used as spring hooks 17. A hook at one end of the urging member 14 can be hooked on the spring hook 17.

The guide 12 is made, for example, from resin. As depicted in FIG. 2, the guide 12 is supported by the frame 11 to be movable in the front-rear direction 8. The guide 12 includes a curved wall 12A, a right wall 12R, a left wall 12L, four shafts 18 (see FIGS. 3A and 3B), and four rollers 19.

The curved wall 12A has the outside curved surface 12A1 The outside curved surface 12A1 has the above shape. The length in the left-right direction 9 of the outside curved surface 12A1 is slightly shorter than the distance between the right wall 11R and the left wall 11L of the frame 11. In the following, a surface passing through the center in the left-right direction 9 of the curved wall 12A is referred to as a reference plane E (see FIGS. 3A and 3B).

The right wall 12R has a plate-like shape extending in the up-down direction 7 and the front-rear direction 8. Specifically, the right wall 12R extends from an entire area of a right end of the curved wall 12A. As depicted in FIG. 2, part of the right wall 12R close to its lower end extends frontward beyond a front end of the curved wall 12A. The right wall 12R is formed having a slit-like guide groove 20R extending downward from a position close to the upper end of the outside curved surface 12A1. The guide groove 20R has a rectangular shape that is long in the up-down direction 7 when seen from the left-right direction 9.

Figure 4A:
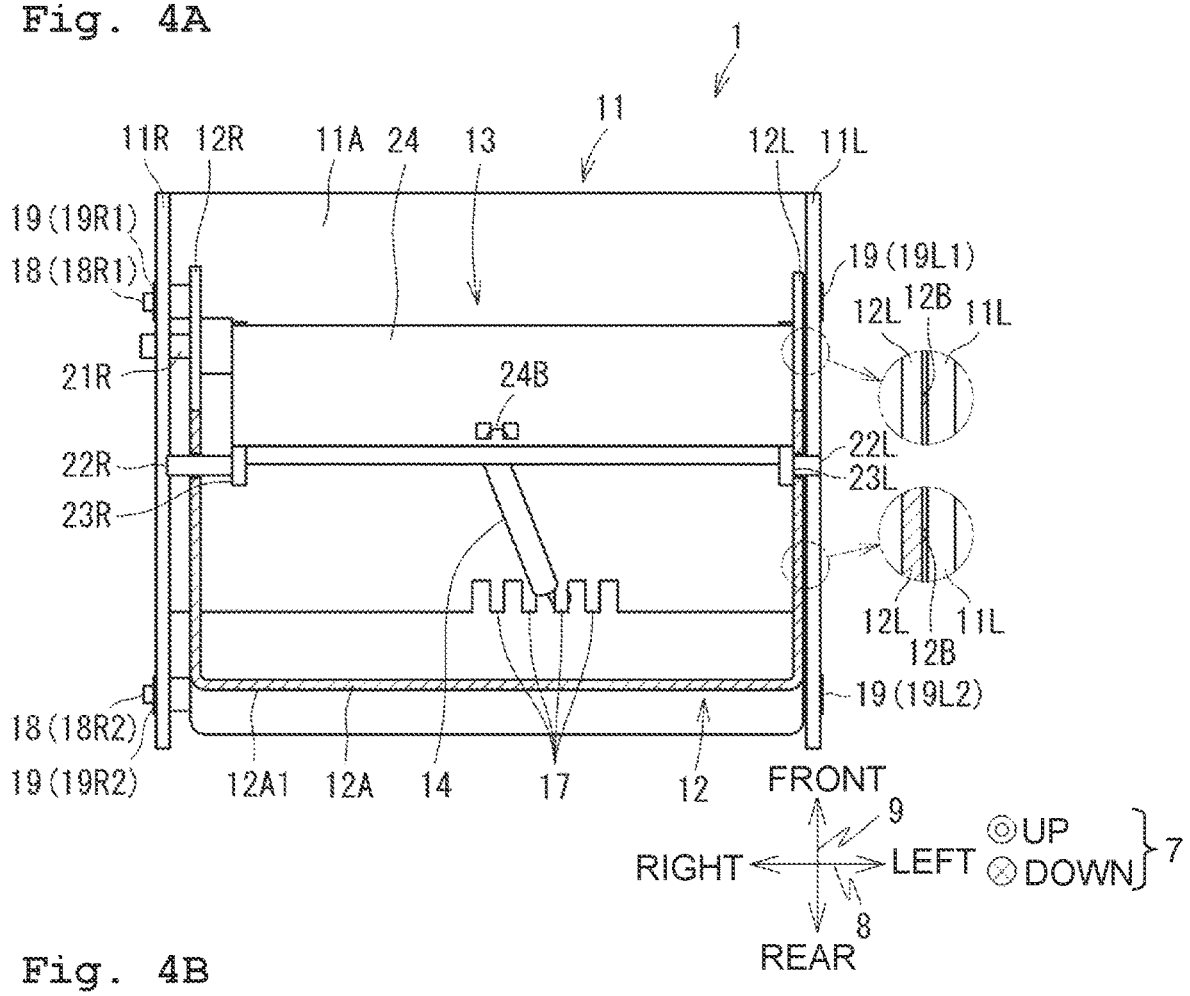
FIG. 4A is a cross-sectional view of the tensioner taken along a dot-dash chain line IVA-IVA in FIGS. 3A and 3B when seen from above.
Figure 4B:
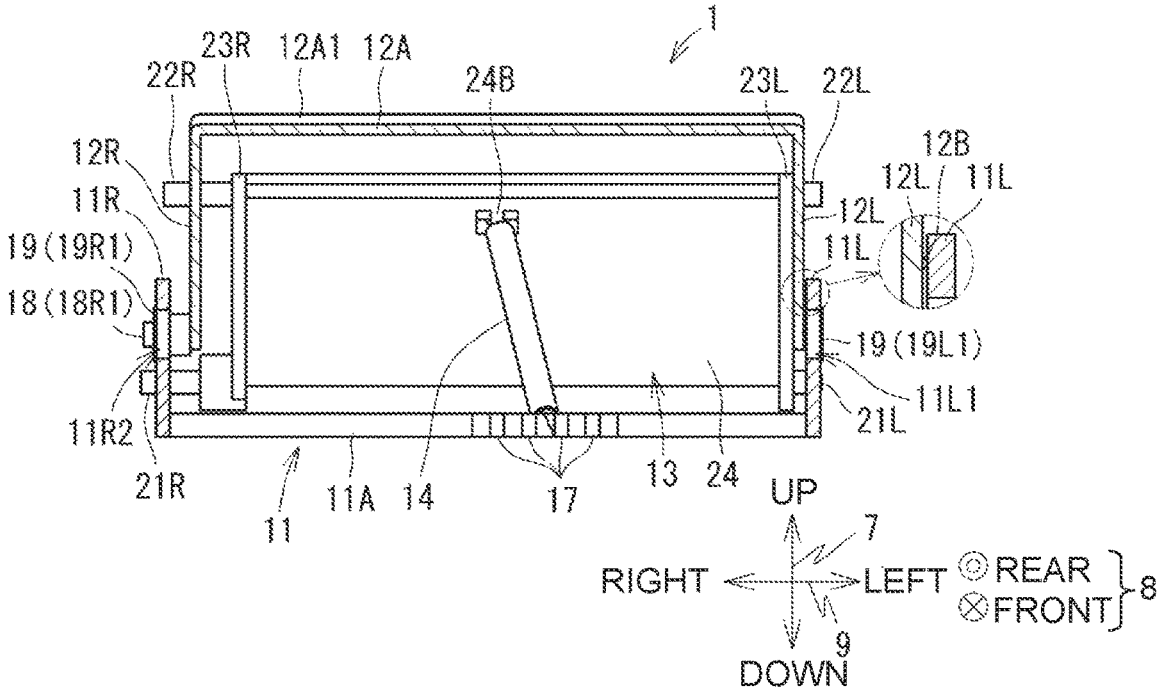
FIG. 4B is a cross-sectional view of the tensioner taken along a dot-dash chain line IVB-IVB in FIG. 2 when seen from a rear side.

The left wall 12L is symmetrical to the right wall 12R with respect to the reference plane E. A guide groove 20L, which is symmetrical to the guide groove 20R of the right wall 12R with respect to the reference plane E, is positioned in the left wall 12L. As depicted in FIGS. 4A and 4B, two protrusions 12B protrude leftward from the left wall 12L. The two protrusions 12B have the same position in the up-down direction 7 and are apart from each other in the front-rear direction 8. The two protrusions 12B protrude leftward by the same amount. The two protrusions 12B have the same shape. The guide grooves 20R and 20L are an exemplary another groove pair.

The four shafts 18 include shafts 18R1, 18R2, 18L1, and 18L2. The shafts 18R1 and 18R2 have the same shape. The shafts 18R and 18R2 protrude rightward from a position close to the lower end of the right wall 12R. The shaft 18R1 is positioned close to a front end of the right wall 12R, and the shaft 18R2 is positioned close to a rear end of the right wall 12R. The shaft 18R1 is separated from the shaft 18R2 in the front-rear direction 8. The shafts 18R1 and 18R2 have the same position in the up-down direction 7. The shafts 18L1 and 18L2 have the same shape. The shape of the shafts 18L1 and 18L2 may be different from or the same as the shape of the shafts 18R1 and 18R2. The protruding position of the shaft 18L1 in the left wall 12L is symmetrical to the protruding position of the shaft 18R1 in the right wall 12R with respect to the reference plane E. The protruding position of the shaft 18L2 in the left wall 12L is symmetrical to the protruding position of the shaft 18R2 in the right wall 12R with respect to the reference plane E.

The four rollers 19 include rollers 19R1, 19R2, 19L1, and 19L2 having the same shape. The rollers 19R1, 19R2, 19L1, and 19L2 are respectively attached to protruding ends of the shafts 18R1, 18R2, 18L1, and 18L2 to be rotatable around the shaft cores of the shafts 18R1, 18R2, 18L1, and 18L2. Each roller 19 has the same diameter as a size in the up-down direction 7 of the guide groove 11R1. Each of the rollers 19R1 and 19R2 is fit in and engaged with the corresponding one of the guide grooves 11R1 and 11R2. Each of the rollers 19L1 and 19L2 is fit in and engaged with the corresponding one of the guide grooves 11L1 and 11L2. The pair of rollers 19R1 and 19L1 and the pair of rollers 19R2 and 19L2 are an exemplary engagement member pair.

As depicted in FIG. 2, the pivoting member 13 includes a pair of shafts 21R and 21L, a pair of pins 22R and 22L, a right plate 23R, a left plate 23L, and a coupling plate 24. The pin 22L is not depicted in FIG. 2, but depicted in FIG. 3B.

The shafts 21R and 21L are inserted into the respective bearings 16R and 16L. The shafts 21R and 21L are supported by the respective bearings 16R and 16L so that they can pivot around their shaft cores.

The pins 22R and 22L have a cylindrical shape having the same diameter as a size in the front-rear direction 8 of the guide grooves 20R and 20L. Although the size in the left-right direction 9 of the pin 22R is different from that of the pin 22L as depicted in FIGS. 4A and 4B, they may have the same size in the left-right direction 9. The pins 22R and 22L are fit in and engaged with the respective guide grooves 20R and 20L. The pair of pins 22R and 22L is an exemplary transmission member and an exemplary protrusion.

The right plate 23R and the left plate 23L extend in a radial direction of the shaft cores of the shafts 21R and 21L. The right plate 23R and the left plate 23L have the same oval shape when seen from the left-right direction 9. The right plate 23R and the left plate 23L are positioned along a left side surface of the right wall 12R and a right side surface of the left wall 12L. The right plate 23R connects a left end of the shaft 21R and a left end of the pin 22R. The left plate 23L connects a right end of the shaft 21L and a right end of the pin 22L.

The coupling plate 24 connects the right plate 23R and the left plate 23L so that the right plate 23R faces the left plate 23L in the left-right direction 9. The coupling plate 24 connects the left plate 23L and the right plate 23R within a range from a position close to the shafts 21L and 21R to a position close to the pins 22L and 22R in the radial direction of the shaft cores of the shafts 21R and 21L. The coupling plate 24 has a rectangular shape in plan view. The coupling plate 24 is formed having spring hooks 24B. Specifically, the spring hooks 24B are positioned slightly apart from the center in the left-right direction 9 of an upper end of the coupling plate 24 in the radial direction of the shaft core of the shaft 21R. A hook at the other end of the urging member 14 is hooked on the spring hook 24B.

The urging member 14 is a spring. The spring is an extension coil spring having hooks at both ends. The hook at one end of the urging member 14 is hooked on any one of the spring hooks 17, the hook at the other end of the urging member 14 is hooked on the spring hook 24B. An original length of the urging member 14 is, for example, defined as follows. The pins 22R, 22L are movable in the up-down direction 7 between an upper end position and a lower end position of the guide grooves 20R, 20L. A position of the spring hook 24B when the pin 22R is at the lower end position is referred to as a first position (see FIG. 5A). A position of the spring hook 17 where the hook at one end of the urging member 14 is hooked thereon is referred to as a second position (see FIG. 5A). The original length of the urging member 14 is substantially equal to a distance between the first position and the second position. The hook at one side of the urging member 14 can be hooked on one of the spring hooks 17 that is positioned on the left side of the center in the left-right direction 9 of the bottom portion 1A. In this case, a direction of a load from the urging member 14 includes a rearward component and leftward component. Leftward force is thus applied to the guide 12 via the left plate 23L of the pivoting member 13, and the two protrusions 12B of the guide 12 come into contact with or abut against the left wall 11L of the frame 11. This makes it difficult for the guide 12 to rotate around the up-down direction 7 as an axis, and the guide 12 is not likely to rattle in the left-right direction 9. Namely, the guide 12 easily moves linearly in the front-rear direction 8.

<Operation of Tensioner 1>

Figure 5A:
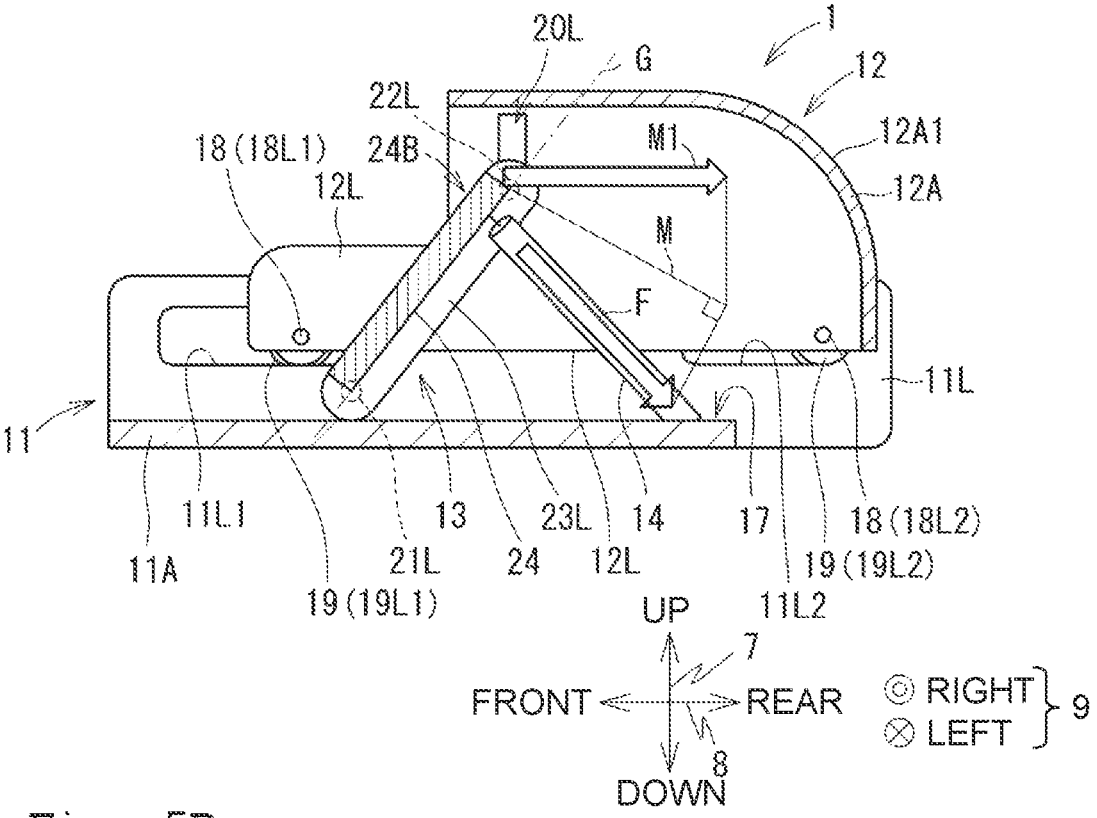
FIG. 5A schematically depicts the tensioner when an urging member is compressed, and FIG. 5B schematically depicts the tensioner when the urging member is extended.
Figure 5B:
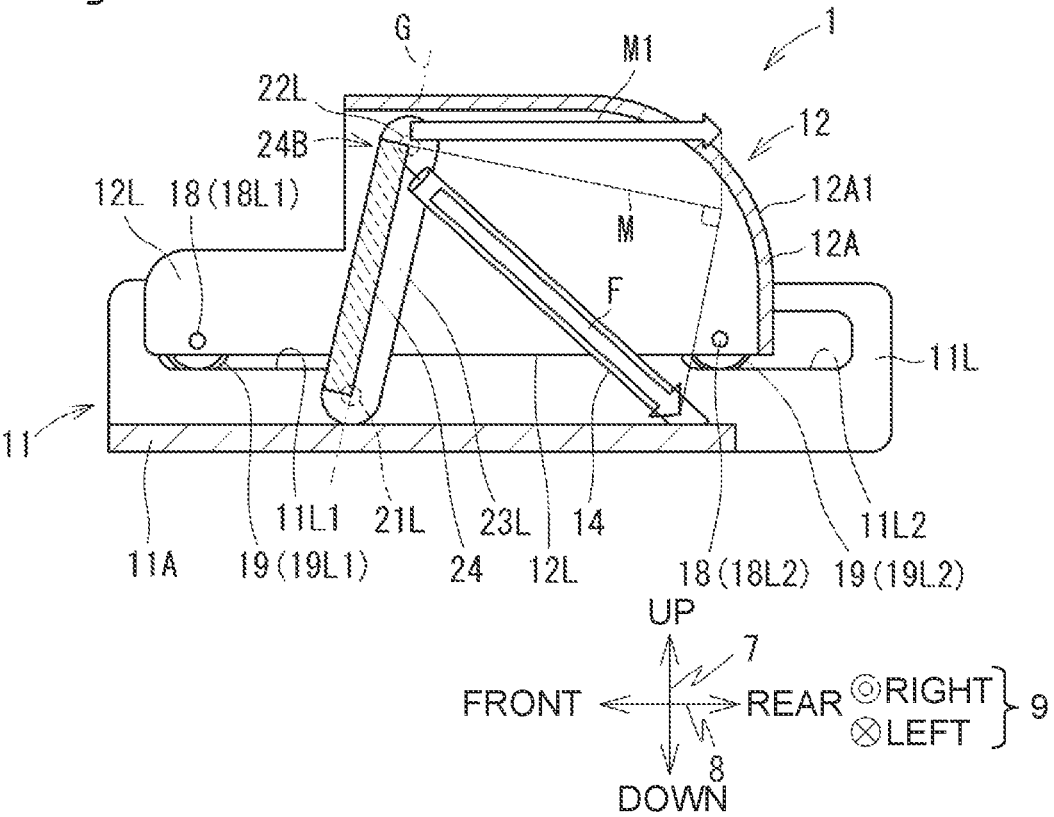

A user pulls out the sheet S from the roll body 31 after installing the roll body 31 in the holder 35 as depicted in FIG. 1, and hooks the sheet S on the outside curved surface 12A1 of the tensioner 1. Then, the user causes the conveyance roller pair 36 to nip the front end of the sheet S. At this time, the center in the width direction of the sheet S is aligned with the sheet passing center C. When the conveyance roller pairs 36 and 40 in the image recording apparatus 30 rotate after the positional alignment, the sheet S is conveyed toward the discharge opening 33 in the conveyance orientation 8A. During conveyance of the sheet S, external force in the conveyance orientation 8A from the sheet S is applied to the outside curved surface 12A1 of the tensioner 1. The rollers 19L1, 19L2, 19R1, and 19R2 thus move in the conveyance orientation 8A while rolling in the respective guide grooves 11L1, 11L2, 11R1, and 11R2. This moves the guide 12 in the conveyance orientation 8A. The movement of the guide 12 causes the guide grooves 20L and 20R to apply external force in the conveyance orientation 8A to the pins 22L and 22R. As a result, the pivoting member 13 pivots counterclockwise around the axes of the shafts 21L and 21R when seen from the right side. This moves the pins 22L and 22R upward along the guide grooves 20L and 20R. The urging member 14 thus extends in an extending direction from the spring hook 17 toward the spring hook 24B, which applies, to the pivoting member 13, urging force F in a compressing direction opposite to the extending direction as depicted in FIGS. 5A and 5B. The urging force F generates, in the pins 22L and 22R, moment M around the axes of the shafts 21L and 21R as depicted in FIGS. 5A and 5B. A component M1 in the front-rear direction 8 of the moment M (specifically, rearward component) is drag against the external force applied from the sheet S to the guide 12. The guide 12 stops at a position where the external force and the drag are balanced, which applies tension to the sheet S on the conveyance path 43. The guide 12 comes into contact with or abuts against the left wall 11L of the frame 11 due to a component M2 in the left-right direction 9 of the moment M (specifically, leftward component), which determines the position in the left-right direction 9 of the guide 12.

<Working Effect of Tensioner 1>

In the tensioner 1, the guide grooves 11L1, 11L2, 11R1, and 11R2 extend in the front-rear direction 8, and thus the guide 12 easily rotates around the axis in the up-down direction 7. The pivoting member 13, however, can pivot around the shaft cores of the shafts 21L and 21R along the left-right direction 9 due to the component in the front-rear direction 8 of the urging force from the urging member 14. This pivoting movement rotates the pins 22L and 22R in a circumferential direction of the shaft cores of the shafts 21L and 21R, thus transmitting equal force to the guide grooves 20L and 20R. This makes it difficult for the guide 12 moving in the front-rear direction 8 to pivot around the axis extending in the up-down direction 7, and the guide 12 is not likely to rattle in the left-right direction 9.

In the tensioner 1, the urging member 14 is compressed as the guide 12 moves toward the outside of the outside curved surface 12A1 (i.e., a direction opposite to the conveyance orientation 8A), as depicted in FIG. 5A. This reduces urging force of the urging member 14, and makes an inferior angle, which is formed by the front-rear direction 8 and a virtual plane G (see FIG. 5A) including the shaft cores of the shafts 21L and 21R and the central axes of the pins 22L and 22R, small. Thus, great drag is applied to the guide 12 when great external force is applied from the sheet S to the guide 12, and small drag is applied to the guide 12 when small external force is applied from the sheet S to the guide 12.

The guide 12 abuts against the left wall 11L of the frame 11 due to the component in the left-right direction 9 of the urging force (specifically, leftward component). The guide 12 is thus not likely to rattle in the left-right direction 9.

In the pivoting member 13, the coupling plate 24 connects the left plate 23L and the right plate 23R at a position close to the pins 22L and 22R in the radial direction of the shaft cores of the shafts 21L and 21R. The pins 22L and 22R are thus not likely to have a positional shift in the circumferential direction of the shaft cores of the shafts 21L and 21R. This allows the pins 22L and 22R to easily transmit equal force to the guide grooves 20L and 20R.

Since the spring hooks 17 are formed in the bottom portion 1A, it is easy to adjust magnitude of the component in the front-rear direction 8 of the urging force and magnitude of the component in the left-right direction of the urging force.

<First Modified Example of Tensioner 1>

In the above embodiment, the guide grooves 11R1, 11R2, 11L1, and 11L2 are formed in the frame 11, and the guide 12 includes the rollers 19R1, 19R2, 19L1, and 19L2 corresponding to the guide grooves 11R1, 11R2, 11L1, and 11L2. The present disclosure, however, is not limited thereto. In the tensioner 1, the guide grooves 11R1, 11R2, 11L1, and 11L2 may be formed in the guide 12, and the frame 11 may include the rollers 19R1, 19R2, 19L1, and 19L2 corresponding to the guide grooves 11R1, 11R2, 11L1, and 11L2. The pair of guide grooves 11R1 and 11L1 and the pair of guide grooves 11R2 and 11L2 of the guide 12 are an exemplary groove pair. The pair of rollers 19R1 and 19L1 and the pair of rollers 19R2 and 19L2 of the frame 11 are an exemplary engagement member pair.

<Second Modified Example of Tensioner 1>

Figure 6A:
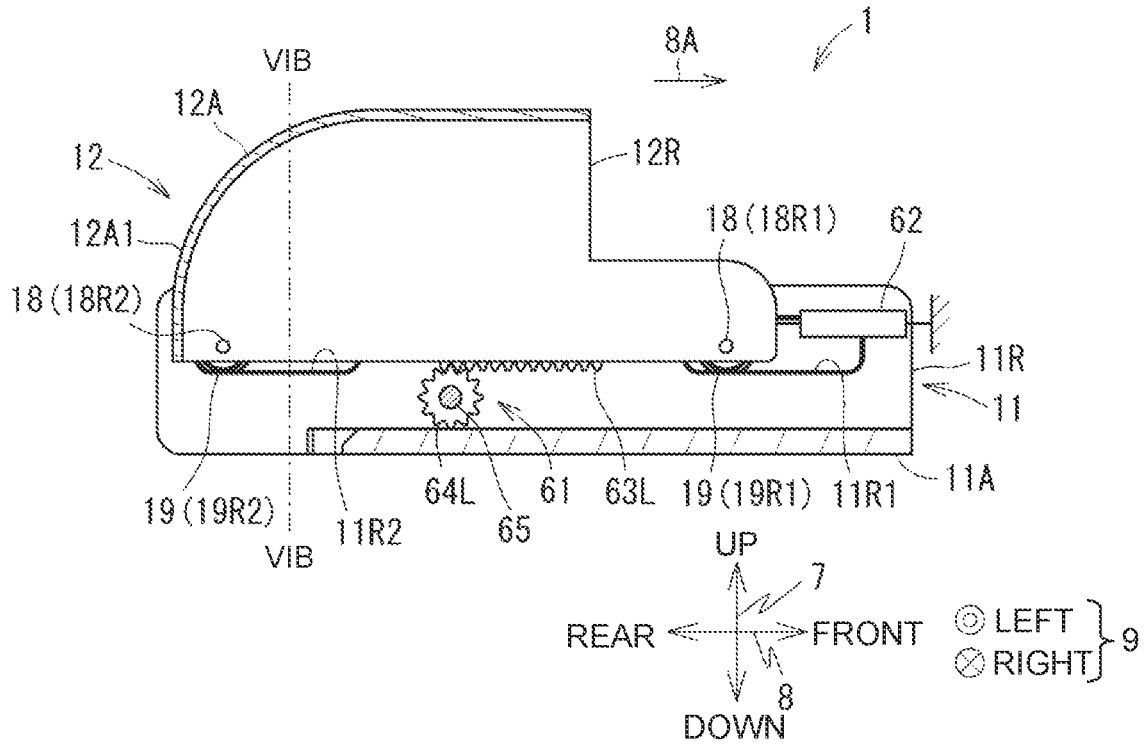
Figure 6B:
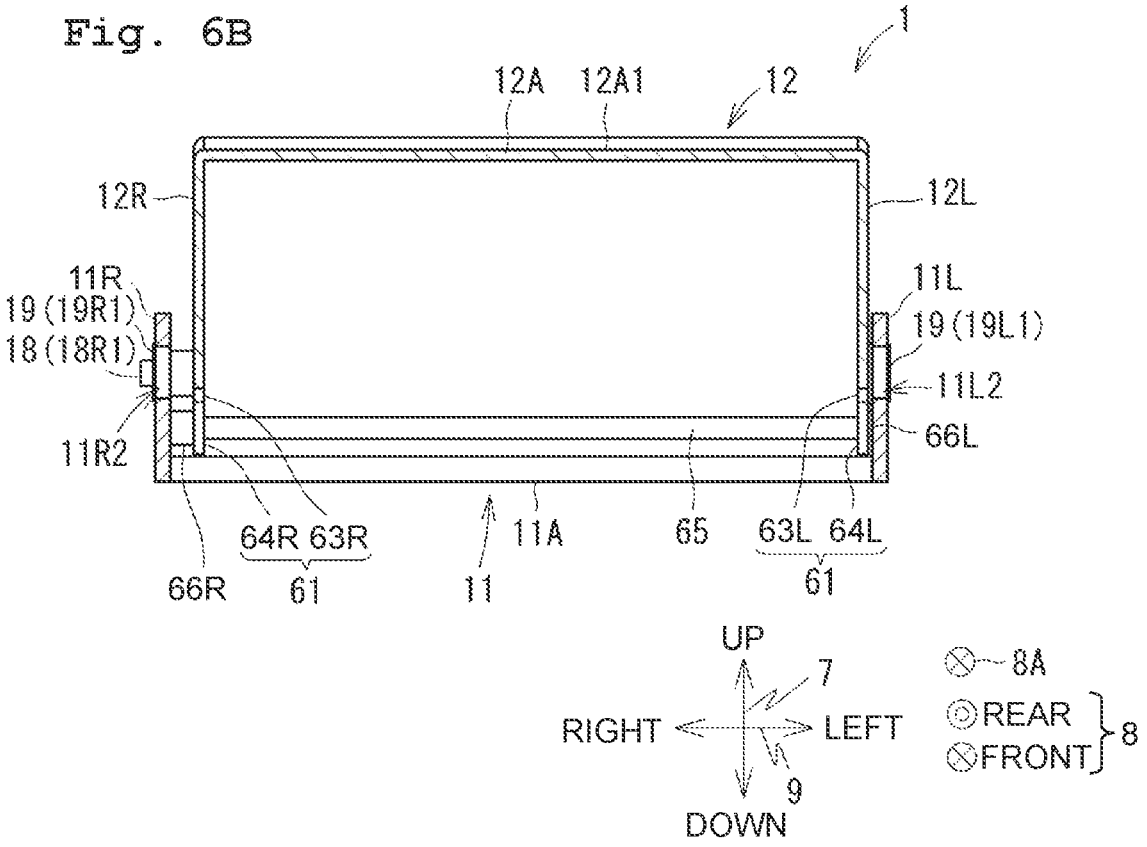

Referring to FIGS. 6A and 6B, a second modified example of the tensioner 1 is explained below.

The tensioner 1 according to the second modified example is different from the tensioner 1 according to the above embodiment in that a rack-and-pinion mechanism 61 and an urging member 62 are provided instead of the pivoting member 13 and the urging member 14. Thus, the constitutive parts or components in the second modified example, which are the same as or equivalent to those of the embodiment described above, are designated by the same reference numerals, any explanation therefor is omitted as appropriate.

The urging member 62 is a compression coil spring. The urging member 62 includes hooks at both ends. The hook at a first end of the urging member 62 is hooked on the casing 32 or the frame 11, and the hook at a second end of the urging member 62 is hooked on a position close to a front end of the guide 12. The urging member 62 applies, to the guide 12, urging force in the direction opposite to the conveyance orientation 8A.

The rack-and-pinion mechanism 61 includes two rack gears 63L and 63R, two pinion gears 64L and 64R, and a shaft 65.

As depicted in FIG. 6A, the rack gear 63L is a gear formed along in the front-rear direction 8 at a lower end of the left wall 12L of the guide 12. As depicted in FIG. 6B, the rack gear 63R is a gear formed along the front-rear direction 8 at the lower end of the right wall 12R of the guide 12. The rack gear 63L is symmetrical to the rack gear 63R in the left-right direction 9.

Each of the pinion gears 64L and 64R is a circular gear having a small diameter. The pinion gear 64L is attached to a front end of a shaft 66L that extends rightward from the left wall 11L of the frame 11. The pinion gear 64L is rotatable around a shaft core of the shaft 66L. The pinion gear 64R is attached to a front end of a shaft 66R that extends leftward from the right wall 11R of the frame 11. The pinion gear 64R is rotatable around a shaft core of the shaft 66R. The pinion gear 64L is symmetrical to the pinion gear 64R in the left-right direction 9. The pinion gears 64L and 64R mesh with the rack gears 63L and 63R.

The shaft 65 connects the center of a right side surface of the pinion gear 64L and the center of a left side surface of the pinion gear 64R. The shaft 65 is a rod-like member extending linearly in the left-right direction 9. When external force is applied from the sheet S to the guide 12, the shaft 65 causes the pinion gears 64L and 64R to rotate in the front-rear direction 8.

The urging member 62 applies, to the guide 12, urging force against the external force applied to the guide 12, while the conveyance roller pair 36 conveys the sheet S (see FIG. 1) in the conveyance orientation 8A. In the rack-and-pinion mechanism 61, the pinion gear 64L is coupled to the pinion gear 64R by the shaft 65, and the pinion gears 64L and 64R rotate while meshing with the rack gears 63L and 63R respectively. The guide 12 moving in the front-rear direction 8 is thus not likely to pivot around the axis in the up-down direction 7, and is not likely to rattle in the left-right direction 9.

<Other Modified Examples of Tensioner 1>

In the above embodiment, the sheet S is conveyed by the conveyance roller pair 36. The present disclosure, however, is not limited thereto. The image recording apparatus 30 may convey the sheet S by any other conveyance member such as a conveyance belt.

The tank 34 is not limited to a tank that stores black ink only. A plurality of tanks storing different colors of inks may be provided. The different colors of inks may be black, yellow, cyan, and magenta inks. Ink containing resin curable by ultraviolet rays may be used as ink. In that case, the fixing unit 39 is not the halogen heater but an ultraviolet irradiator.

The image recording apparatus 30 records an image on a sheet in accordance with an ink-jet system. Instead of this, an image may be recorded in accordance with an electrophotographic system or a thermal head may be adopted. In this case, the fixing unit 39 may be omitted if not required.

It is not indispensable to form the discharge opening 33 in the front surface 32F of the casing 32. For example, the discharge opening 33 is formed in the upper surface 32U of the casing 32, and the sheet S for which image recording has been performed may pass through the discharge opening 33 so that the sheet S is discharged upward or obliquely upward.

The image recording apparatus 30 is used in a state where the front surface 32F and the rear surface 32B of the casing 32 are along the up-down direction and the left-right direction. The usable posture of the image recording apparatus 30, however, is not limited to this.

What is claimed is:

1. A conveyor, comprising:

a receiver configured to detachably receive a roll-like sheet, a conveyance unit configured to convey the sheet pulled out from the receiver in a conveyance orientation along a conveyance surface; and a tensioner configured to apply tension to the sheet at a position upstream of the conveyance unit in the conveyance orientation, wherein the tensioner includes:

a frame having a groove pair each extending in a first direction along the conveyance orientation, a guide having a curved surface configured to contact the sheet and an engagement member pair configured to engage with the groove pair, a pivoting member configured to pivot around an axis extending in a second direction that is orthogonal to the first direction and is parallel to the conveyance surface, a transmission member configured to transmit pivoting of the pivoting member to the guide, and an urging member configured to apply, to the guide, urging force including a component in the first direction.

2. A conveyor, comprising:

a receiver configured to detachably receive a roll-like sheet, a conveyance unit configured to convey the sheet pulled out from the receiver in a conveyance orientation along a conveyance surface; and a tensioner configured to apply tension to the sheet at a position upstream of the conveyance unit in the conveyance orientation, wherein the tensioner includes:

a frame having an engagement member pair, a guide having a curved surface configured to contact the sheet and a groove pair configured to engage with the engagement member pair, the groove pair each extending in a first direction along the conveyance orientation, a pivoting member configured to pivot around an axis extending in a second direction that is orthogonal to the first direction and is parallel to the conveyance surface, a transmission member configured to transmit pivoting of the pivoting member to the guide, and an urging member configured to apply, to the guide, urging force including a component in the first direction.

3. The conveyor according to claim 1, wherein the guide includes another groove pair each extending in a third direction that is orthogonal to the first direction and the second direction, and the transmission member is a protrusion pair that protrudes from the pivoting member to fit in the another groove pair.

4. The conveyor according to claim 3, wherein the urging member is a coil spring configured to urge the pivoting member.

5. The conveyor according to claim 4, wherein as the guide moves toward an outside of the curved surface, the urging force of the urging member is reduced and an inferior angle becomes smaller, the inferior angle being formed by the first direction and a virtual plane that includes a shaft core of a shaft having the axis as a rotation axis and a center of the protrusion pair.

6. The conveyor according to claim 1, wherein the urging force of the urging member includes a component in the second direction.

7. The conveyor according to claim 1, wherein the pivoting member includes a shaft having the axis as a rotation axis, and the frame has a hole into which the shaft is rotatably fit around the rotation axis.

8. The conveyor according to claim 1, wherein the urging member is configured to apply, to the guide, urging force that includes a component of which orientation is opposite to the conveyance orientation.

9. An image recording apparatus, comprising:

the conveyor as defined in claim 1, and a recording unit configured to record an image on the sheet at a position separated from the conveyance unit in the conveyance orientation.

10. The conveyor according to claim 2, wherein the guide includes another groove pair each extending in a third direction that is orthogonal to the first direction and the second direction, and the transmission member is a protrusion pair that protrudes from the pivoting member to fit in the another groove pair.

11. The conveyor according to claim 10, wherein the urging member is a coil spring configured to urge the pivoting member.

12. The conveyor according to claim 11, wherein as the guide moves toward an outside of the curved surface, the urging force of the urging member is reduced and an inferior angle becomes smaller, the inferior angle being formed by the first direction and a virtual plane that includes a shaft core of a shaft having the axis as a rotation axis and a center of the protrusion pair.

13. The conveyor according to claim 2, wherein the urging force of the urging member includes a component in the second direction.

14. The conveyor according to claim 2, wherein the pivoting member includes a shaft having the axis as a rotation axis, and the frame has a hole into which the shaft is rotatably fit around the rotation axis.

15. The conveyor according to claim 2, wherein the urging member is configured to apply, to the guide, urging force that includes a component of which orientation is opposite to the conveyance orientation.

16. An image recording apparatus, comprising:

the conveyor as defined in claim 2, and a recording unit configured to record an image on the sheet at a position separated from the conveyance unit in the conveyance orientation.

* * * * *